United States Patent [19]

Sakurai et al.

[11] 4,327,263

[45] Apr. 27, 1982

[54] SWITCHING DEVICE

[75] Inventors: Takeyoshi Sakurai, Amagasaki; Noboru Kobayashi, Kobe, both of Japan

[73] Assignee: Mitsubishi Denke Kabushiki Kaisha, Tokyo, Japan

[21] Appl. No.: 160,249

[22] Filed: Jun. 17, 1980

[51] Int. Cl.[3] ..... H01H 33/88

[52] U.S. Cl. ..... 200/148 A; 200/150 G

[58] Field of Search ..... 200/148 A, 150 G

[56] References Cited

U.S. PATENT DOCUMENTS 4,225,762 9/1980 Zuckler ..... 200/148 A 4,242,550 12/1980 Kii ..... 200/148 A

FOREIGN PATENT DOCUMENTS 2043744 3/1980 Fed. Rep. of Germany ... 200/148 A

*Primary Examiner*—Robert S. Macon

*Attorney, Agent, or Firm*—M. S. Yatsko

[57] ABSTRACT

A gas-insulated switch has separable contacts disposed within a chamber-forming cylinder. The arc drawn between the contacts on opening provides pressurizing of the arc-extinguishing fluid in the chamber, while additional pressurization is provided by an interlocking member which has an interlocked movement with the contacts during the opening operation.

1 Claim, 5 Drawing Figures

SWITCHING DEVICE

BACKGROUND OF THE INVENTION

This invention relates generally to switching devices, and more particularly, to a self arc-extinguishing gas-type switch which utilizes a high pressure fluid pressurized by an arc across contact members to extinguish the arc.

A prior art self arc-extinguishing switch is illustrated in FIG. 1, where an end plate 1 mounted to an insulating cylinder 15, and has one end connected to a line 2, and the other end forming a stationary contact member 3. A member 4 forms an arc-extinguishing fluid containing pressurizing chamber 12, one end thereof being mounted to the end plate 1 and the other end 52 thereof forming a flat plate provided with an opening 5. A heat resisting, insulating member 6 has one end 53 mounted to the end plate 4, and the other end 54 cylindrical and opened. A movable rod 7 has one end forming a movable contact member 55 capable of contacting the stationary contact member 3 and the other end connected to an operating device (not shown). A communicating hole 8 is disposed in the movable rod 7, and a finger contact 9 is mounted to a terminal plate 10. A lead 11 is connected to the terminal plate 10. The terminal plate 10 is mounted to an insulating cylinder 15, and a sliding member 14 is disposed on that portion of the terminal plate 10 into which the movable rod 7 is fitted.

The conventional switching device is constructed as described above and during the closure a current flows from the line 2 through the end plate 1, the stationary contact 3, the movable contact 55, the rod 7, the finger contact 9, and the terminal plate 10 to the lead 11. In the opening operation the movable rod 7 is drawn downwardly by the operating device and an arc 13 is generated between the stationary 3 and movable 7 contacts. This arc generating space blocks off the cylindrical portion 54 at the extremity of the member 6 with a high temperature high pressure fluid while at the same time the energy of the arc itself pressurizes the arc extinguishing fluid 51 in the pressure chamber 12. However, for alternating current, the spontaneous zero point exists. As the zero point is approached, the arc current decreases and the blockage is released to put the arc space under a low pressure. Thus, the arc extinguishing fluid 51, confined in the pressure chamber 12 and put under a high pressure, is conversely blown against the arc 13 to extinguish the arc 13 at the zero point while the cooling action is performed.

Because in the so-called arc-extinguishing type switch the interruption is effected by increasing the pressure of the arc extinguishing fluid with energy possessed by the current which itself is intended to be interrupted, as described above, there has been the disadvantage that, for low interrupting currents, the pressure in the pressure chamber 12 is not sufficiently raised and an effective stream of fresh arc extinguishing fluid, required for the interruption, cannot be blown against the arc. This has resulted in the disadvantage that the interruption of high currents cannot be compatible with that of low currents because the pressure in the chamber 12 is not raised sufficiently with the interruption of low current because the volume of the pressure chamber 12 is sized to ensure sufficiently of the arc extinguishing fluid required for high current arcs to be extinguished.

Futher, there has been the disadvantage that in conventional devices the interrupting capacity is limited.

This occurs because, even though the volume of the pressure chamber 12 increases, the communicating hole 8 is disposed only on the movable side, so that the discharge of the high temperature fluid of poor arc-extinguishing property in the arc space and of floating conductive particles vaporized by the arc from metals constituting the contact members is not sufficient.

The present invention aims to provide an arc extinguishing chamber in a switching device which as well as making an improvement of the small current interrupting capability in self arc-extinguishing chambers also makes the interruption of large currents easier.

SUMMARY OF THE INVENTION

In accordance with the invention, a switching device includes a pair of separable contact members having respective openings and an arc-extinguishing fluid-containing chamber where the arc generated between the separable contacts pressurizes the fluid. An interlocking member, coaxial with the separable contacts, functions in an interlocked movement with the separation of the contacts to provide additional pressurization of the chamber.

BRIEF DESCRIPTION OF THE DRAWINGS

Reference is now made to the Description of the Preferred Embodiment, illustrated in the accompanying Figures, in which.

DESCRIPTION OF THE PREFERRED EMBODIMENT

Figure 1:
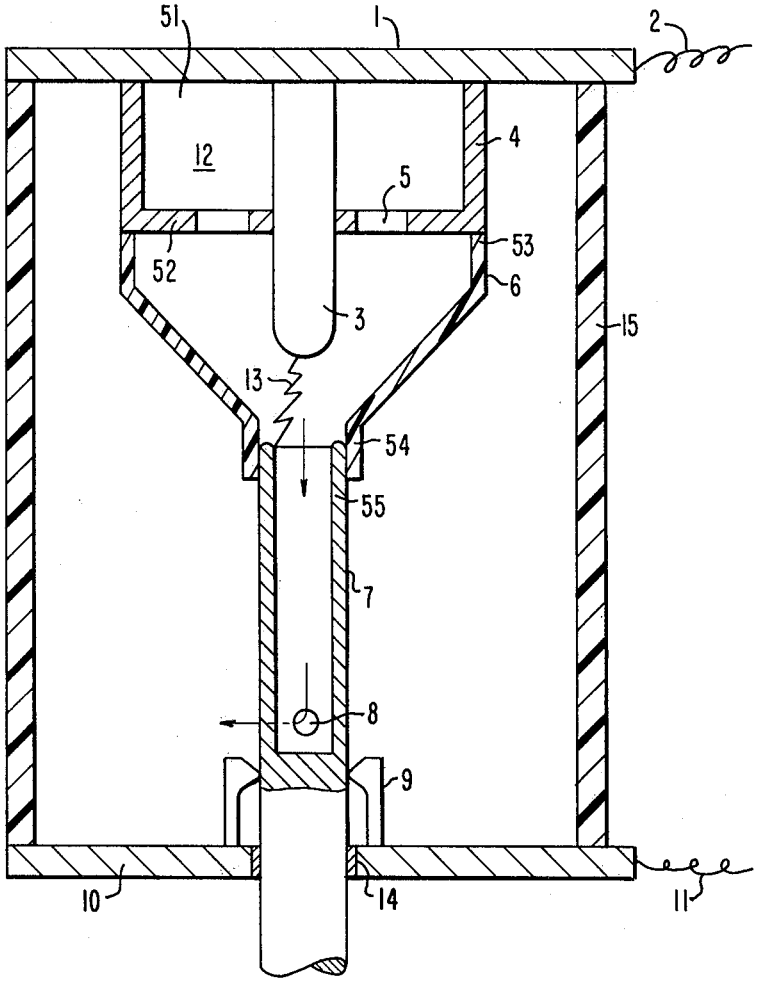
FIG. 1 PRIOR ART
FIG. 1 is a sectional view showing a conventional prior art switching device.
Figure 2:
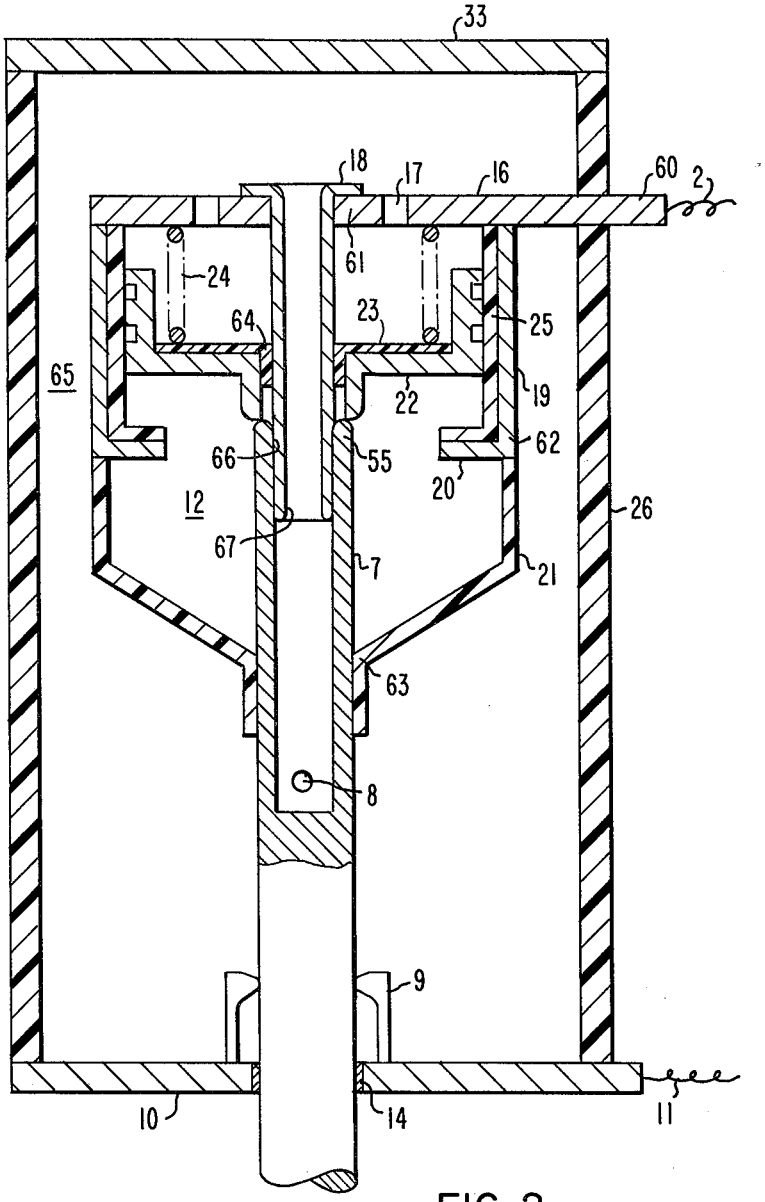
FIG. 2 is a sectional view showing the closed state of one embodiment of the present invention.

Referring now more particularly to FIG. 2, the line 2, the movable rod 7 having the movable contact 55 at one end thereof, the communicating hole 8, the finger contact 9 and terminal plate 10, the lead 11, the pressurizing chamber 12 and the sliding member 14 are the same as in the prior art switch illustrated in FIG. 1. In the switch shown in FIG. 2, an upper cover 33 is mounted to an insulating cylnder 26. A terminal plate 16 extends through the insulating cylinder 26 and is integral with said insulating cylinder 26, with one end 60 thereof connected to the lead 2. A communicating hole 17 is disposed on the terminal plate 16 and a hollow cylindrical stationary contact member 18 is connected to the terminal plate 16 at the other end thereof. A depending member 19 forming the pressure chamber 12 is provided at one end 62 with a flange 20 and the other end of the member 19 is connected to the terminal plate 16. The end 62 of the member 19 has a heat resisting insulating member, or insulating nozzle, 21 mounted thereto. The insulating nozzle 21 is provided at its extremity 63 with an opening sized about the movable rod 7. An interlocking member 22 forms a piston, while an insulating slide member 23 is mounted to the interlocking member 22 and has an inner cylindrical portion 64 fitted about the outer cylindrical portion of the stationary contact member 18. A spring 24 is disposed between the interlocking member 23 and the terminal plate 20. A cylinder 25, consisting of an insulating sliding material such as Teflon, is fitted onto the inner cylindrical surface of the depending member 19 and is mounted by having both end surfaces sandwiched between the terminal plate 16 and the flange 20. The interlocking member 22, the slide member 23, the spring 24 and the cylinder 25 together form a pressurizing device 65.

Figure 3:
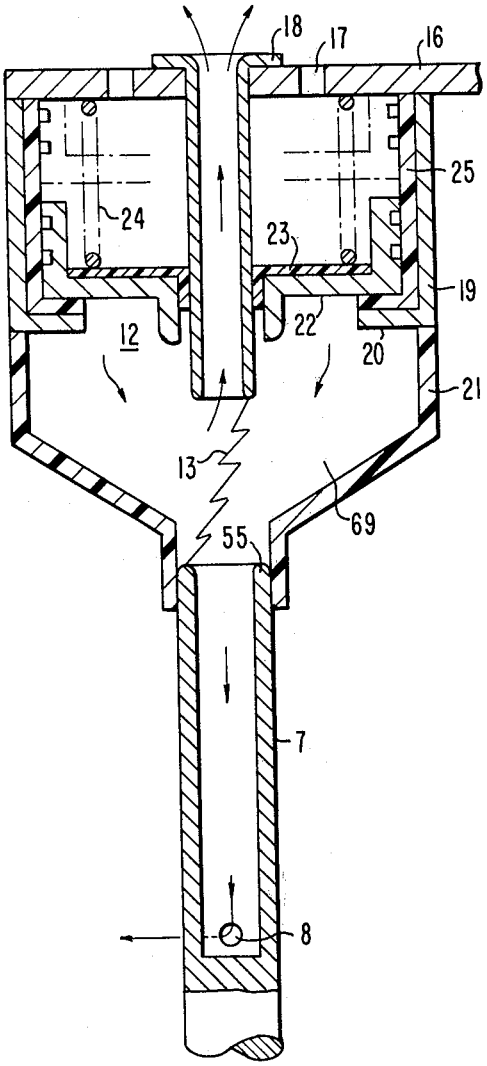
FIG. 3 is a sectional view of one embodiment of the present invention with the contacts partially open.
Figure 4:
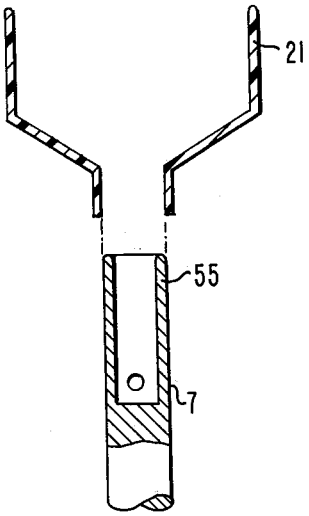
FIG. 4 is a sectional view showing the open state of one embodiment of the present invention.

In the switching device constructed as described above, the operating device (not shown) is operated with a command, for example to close, (FIG. 4) and pushes the movable rod 7 upward so that the latter slides along and passes through the opening of the insulating nozzle 21 and engages the stationary contact member 18 as shown in FIG. 2. The movable contact 55 is contacted by the interlocking member 22 while being slidingly further pushed up until the spring 24 is compressed, resulting in the closed state of FIG. 2. At that time, a current flows from lead 2 through terminal plate 16, stationary contact 18, movable contact 55, rod 7, finger contact 9 and lower plate 10 to the line 11. As the spring 24 and the interlocking member 22 are insulated by the insulating members 23 and 25, respectively, a current does not flow therethrough. When a command for the opening is issued, the operating device is operated to pull the movable rod 7 downward. At that time, the interlocking member 22 is driven downward by the spring 24, and the arc-extinguishing fluid in the pressure chamber 12 is compressed to increase in pressure. When the movable rod 7 is further pulled downward and the movable contact 55 is out of engagement with the stationary contact 18, an arc 13 is generated as shown in FIG. 3. Where the current to be interrupted is low, the arc energy is small, with the result that the pressure in the pressure chamber 12 does not rise enough to generate a flow of fluid 51 sufficient to extinguish the arc 13. And because the arc 13 does not cause the blocking phenomena at the openings of the stationary 18 and movable 55 contacts, it is unable to maintain a small rise in pressure even if it would occur. However, the addition of the pressurizing device 65 can create a stream of the arc-extinguishing fluid 51 leading to the communicating hole 8 to be directed through the arc space 69 to thereby extinguish the arc 13, because the pressure in the pressure chamber 12 is preliminarily raised as described above. At that time the operation of the interlocking member 22 is not necessarily required to follow up the operation of the movable rod 7. If the movable rod 7 has an operating speed faster than that of the interlocking member 22, than an accumulated pressure is discharged through the openings 67, 66 of the contacts 18, 7 as soon as the stationary contact 18 disengages from the movable contact 55. Therefore, the arc-extinguishing action must be performed under a relatively low pressure within the pressure chamber 12. However, there is no hindrance if a pressure sufficient for a low current is intended to be processed.

In the case of interrupting high currents, the arc 13 generated is large in energy so that the pressure in the pressure chamber 12 cooperates with the blocking phenomena at the contacts 18, 55 to be sufficiently raised, as in conventional devices. However, due to the presence of the inner cylindrical portion of the stationary contact member 18 and the communicating hole 8 disposed on the movable rod 7, as shown in FIG. 3, the high temperature fluid ineffective for extinguishing the arc 13 within the arc space 69 and vaporized metal particles detrimental to the extinction of arcs continue to be discharged in two divided directions during the arc generating period, and as the interruption current approaches the zero point a fresh arc-extinguishing fluid in the pressure chamber 12 flows into the arc space, making the extinction of the large current arcs easy.

Also, if the load on the spring 24 is preliminarily set so that, when the pressure in the pressure chamber 12 rises to a predetermined value the interlocking member 22 receiving this pressure is moved upward, then the interlocking member 22 is moved upard upon the interruption of large currents, as shown in double-dotted the alternating chain line in FIG. 3 thereby to make the pressure chamber 12 apparently large. The arc-extinguishing fluid 51 in the space thus large is kept from mixing with the high temperature fluid in the arc space 69, so that the supply of a fresh fluid can be effected and the extinction of large current arcs is easily effected. One end of the sliding member 23 should eventually abut against the terminal plate 16 to form a stopper so as not to compres the spring 24 beyond the closely contacted height thereof upon the interlocking member 22 being moved further upward.

While in the embodiment described above the interlocking member 22 is disposed coaxially on the outer periphery of the stationary contact member 18 the similar operation can be expected with the interlocking member disposed on the inner periphery of 18.

Figure 5:
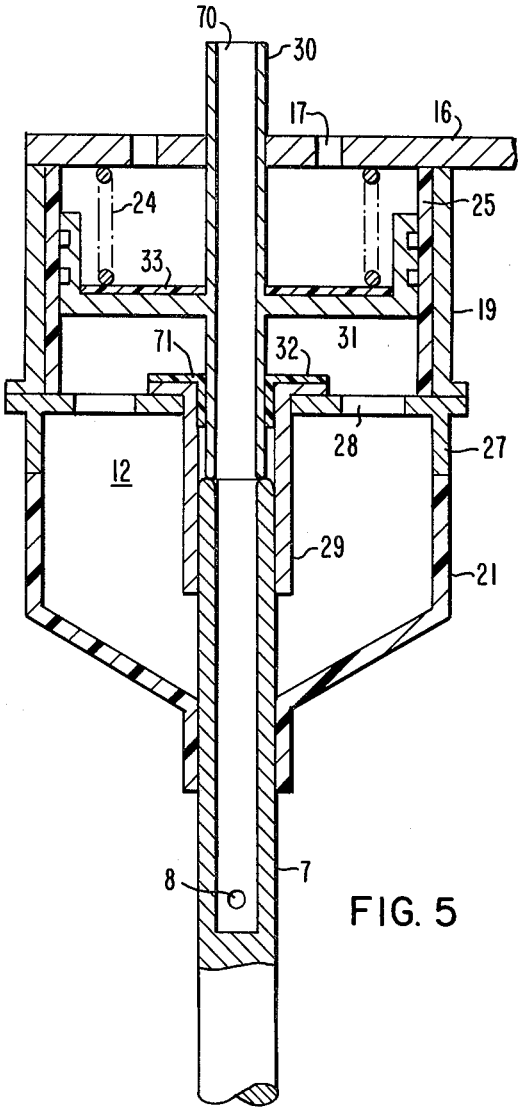
FIG. 5 is a sectional view showing another embodiment of the present invention.

FIG. 5 illustrates another embodiment of the invention with the interlocking member 31 disposed on the inner periphery of the stationary contact member 29. A member 27 with a communicating hole 28 constituting the pressure chamber has one end mounted to the depending member 19 and the other end mounted to the insulating nozzle 21. A stationary contact member 29 has one end mounted to member 27 and the inner peripheral surface of the other end fitted about the outer peripheral surface of the movable rod 7. An interlocking member 30 is utilized with the hollow cylindrical portion of which has a hollow portion forming a communicating hole 70 and the intermediate portion of which is provided with a flange 31 forming a piston. An insulating member 32, the cylindrical portion of which has an inner peripheral surface 71 fitted onto the outer peripheral surface of the interlocking member 30, has an outer peripheral surface fitted into the inner peripheral surface of the stationay contact 29, the current flow is through the plate 16, cylinder 19, and contact 29, and the operation is quite similar to that of FIGS. 2, 3 and 4. An insulating member 33 is disposed under a pressure to the extension 31 by means of the spring 24.

As described above, the present invention is constructed so that the interlocking member is disposed on the coaxial cylinder of the movable contact member with the opening and the stationary contact member to interlocking the contact member thereby to form the pressurizing device whereby there is the effect that the interruption can be effected over a wide current range of from a low current to a high current.

We claim as our invention:

1. A switching device comprising:

a pair of contact members capable of engagement with and separable from each other, said contact members having respective openings therein;

a cylinder surrounding and coaxial with said contact members and forming a chamber containing therein an arc-extinguishing fluid, said arc-extinguishing fluid being pressurized by the arc drawn between said contact members during separation thereof; and additional pressurizing means for pressurizing said arc-extinguishing fluid within said chamber, said additional pressurizing means including an interlocking member disposed on said cylinder and capable of an interlocked movement with said contact members during separation thereof, interlocked movement of said interlocking member during contact member separation pressurizing said arc-extinguishing fluid within said chamber.

* * * * *